US011238742B2

(12) United States Patent
Srinivasan et al.

(10) Patent No.: US 11,238,742 B2
(45) Date of Patent: Feb. 1, 2022

(54) METHODS AND SYSTEMS FOR MITIGATING CLEARANCE AMBIGUITIES

(71) Applicant: HONEYWELL INTERNATIONAL INC., Morris Plains, NJ (US)

(72) Inventors: Narayanan Srinivasan, Chennai (IN); Gobinathan Baladhandapani, Madurai (IN); Hariharan Saptharishi, Trichy (IN)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 1031 days.

(21) Appl. No.: 15/891,884

(22) Filed: Feb. 8, 2018

(65) Prior Publication Data

US 2019/0244528 A1 Aug. 8, 2019

(51) Int. Cl.

| | |
|---|---|
| ***G08G 5/00*** | (2006.01) |
| ***G08G 5/02*** | (2006.01) |
| ***G08G 5/06*** | (2006.01) |

(52) U.S. Cl.

CPC ..... *G08G 5/0013* (2013.01); *G08G 5/00* (2013.01); *G08G 5/0021* (2013.01); (Continued)

(58) Field of Classification Search

CPC ..... G01S 13/781; G05D 1/00; G01C 5/00; G01C 5/005; G01C 21/00; G01C 21/005; (Continued)

(56) References Cited

U.S. PATENT DOCUMENTS 7,184,863 B2 2/2007 Weineck
7,415,326 B2 8/2008 Komer et al.
(Continued)

FOREIGN PATENT DOCUMENTS

EP 1318492 A2 6/2003

OTHER PUBLICATIONS

"Air-Ground Voice Communications," SKYbrary, downloaded from Internet Mar. 28, 2018.
(Continued)

*Primary Examiner* — Anthony R Jimenez
(74) *Attorney, Agent, or Firm* — Lorenz & Kopf, LLP

(57) ABSTRACT

Systems and methods are provided for detecting a potential ambiguity in a sequence of clearance communications using conversational contextual information to identify potentially related communications. One exemplary method involves obtaining a first clearance communication associated with a first aircraft, obtaining a second clearance communication associated with a second aircraft, identifying a first conversational context associated with the first clearance communication, identifying a second conversational context associated with the second clearance communication, identifying a discrepancy between the first clearance communication and the second clearance communication based at least in part on the first conversational context and the second conversational context, and in response to identifying the discrepancy, generating a user notification at one of the first aircraft and the second aircraft.

19 Claims, 5 Drawing Sheets

(52) U.S. Cl.
CPC ..... *G08G 5/0026* (2013.01); *G08G 5/0043* (2013.01); *G08G 5/0082* (2013.01); *G08G 5/02* (2013.01); *G08G 5/065* (2013.01)

(58) Field of Classification Search
CPC ..... G01C 21/28; G01C 21/34; G01C 21/36; G01C 21/3605; G01C 21/362; G01C 21/3626; G01C 21/3635; G01C 21/3638; G01C 21/3644; G01C 23/00; G01C 23/005; G08G 5/06; G08G 7/02; G08G 7/00; G08G 1/0968; G08G 9/02; G08G 9/00; G08G 5/00; G08G 5/0082; G08G 5/0047; G08G 5/003; G08G 5/0026; G08G 5/0021; G08G 5/0017; G08G 5/0013; G08G 5/02; G08G 5/0004; G08G 5/025; G08G 5/04; G08G 5/065; G08G 5/0043
USPC ..... 701/3
See application file for complete search history.

(56) References Cited

U.S. PATENT DOCUMENTS

| | | | |
|---|---|---|---|
| 7,809,405 | B1 | 10/2010 | Rand et al. |
| 7,881,832 | B2 | 2/2011 | Komer et al. |
| 8,149,141 | B2 | 4/2012 | Coulmeau et al. |
| 8,180,503 | B2 | 5/2012 | Estabrook et al. |
| 8,280,741 | B2 | 10/2012 | Colin et al. |
| 8,340,839 | B2 | 12/2012 | Yogesha et al. |
| 8,681,040 | B1 | 3/2014 | Rathinam et al. |
| 8,704,701 | B2 | 4/2014 | Pschierer et al. |
| 8,909,392 | B1 | 12/2014 | Carrico |
| 8,957,790 | B2 | 2/2015 | Cornell et al. |
| 9,190,073 | B2 | 11/2015 | Dong et al. |
| 9,443,433 | B1 | 9/2016 | Conway et al. |
| 9,620,119 | B2 | 4/2017 | Bilek et al. |
| 9,642,184 | B2 | 5/2017 | Plocher et al. |
| 9,704,405 | B2 | 7/2017 | Kashi et al. |
| 2004/0124998 | A1 | 7/2004 | Dame |
| 2004/0263381 | A1 | 12/2004 | Mitchell et al. |
| 2005/0203700 | A1 | 9/2005 | Merritt |
| 2007/0288128 | A1 | 12/2007 | Komer et al. |
| 2011/0028147 | A1 | 2/2011 | Calderhead, Jr. et al. |
| 2011/0125503 | A1 | 5/2011 | Dong et al. |
| 2011/0202351 | A1 | 8/2011 | Plocher et al. |
| 2011/0231036 | A1 | 9/2011 | Yogesha et al. |
| 2013/0103297 | A1* | 4/2013 | Bilek ..... G08G 5/065 701/120 |
| 2015/0162001 | A1 | 6/2015 | Kar et al. |
| 2016/0125744 | A1 | 5/2016 | Shamasundar et al. |
| 2016/0155435 | A1 | 6/2016 | Mohideen |
| 2017/0039858 | A1 | 2/2017 | Wang et al. |
| 2018/0061243 | A1* | 3/2018 | Shloosh ..... G08G 5/0091 |

OTHER PUBLICATIONS

"Loss of Communication," SKYbrary, downloaded from Internet Mar. 28, 2018.

Cardosi, Kim and Tracy Lennertz. "Loss of Controller-Pilot Voice Communications in Domestic En Route Airspace." DOT-VNTSC-FAA-17-04, dated Feb. 2016.

* cited by examiner

400

| JZA-269 | WS-628 | WS-2057 | WJA-269 |
|---|---|---|---|
| ATC: JZA-269 ASSIGNED RICHMOND 1 | | | |
| | ATC: WS-628 ASSIGNED GEORGIA 2 SID LINE UP 26L AND NUMBER 2 FOR DEPARTURE | | |
| | | ATC: CLEARED FOR FINAL APPROACH TO 26L | |
| | | | ATC: WJA-269 CLEARED FOR TAKE OFF RUNWAY 26L RICHMOND 1 |
| PILOT: JZA-269 ROGER, WE ARE IN THE MIDDLE OF RUNWAY 26L | | | |
| | PILOT: WS-628 ROGER, READY TO ROLL | | |

FIG. 4

METHODS AND SYSTEMS FOR MITIGATING CLEARANCE AMBIGUITIES

TECHNICAL FIELD

The subject matter described herein relates generally to vehicle systems, and more particularly, embodiments of the subject matter relate to avionics systems and methods for mitigating potential ambiguities or uncertainties in air traffic control clearance communications.

BACKGROUND

Air traffic control typically involves voice communications between air traffic control and a pilot or crewmember onboard the various aircrafts within a controlled airspace. For example, an air traffic controller (ATC) may communicate an instruction or a request for pilot action by a particular aircraft using a call sign assigned to that aircraft, with a pilot or crewmember onboard that aircraft acknowledging the request (e.g., by reading back the received information) in a separate communication that also includes the call sign. As a result, the ATC can determine that the correct aircraft has acknowledged the request, that the request was correctly understood, what the pilot intends to do, etc.

Unfortunately, there are numerous factors that can cause a failure to hear or reply to a clearance communication, or otherwise result in a misinterpretation of a clearance communication, such as, for example, the volume of traffic in the airspace, similarities between call signs of different aircrafts in the airspace, congestion or interference on the communications channel being utilized, and/or human fallibilities (e.g., inexperience, hearing difficulties, memory lapse, language barriers, distractions, fatigue, etc.). As a result, an incomplete and/or incorrect clearance communication could be acknowledged or acted on by a pilot. This can be particularly consequential when a pilot of one aircraft attempts to adhere to a clearance intended for another aircraft, for example, as a result of call sign confusion. Additionally, potential ambiguity or uncertainty in aircraft behavior is antithetical to maintaining aircraft control. Accordingly, it is desirable to provide aircraft systems and methods for mitigating potential uncertainties or ambiguities with respect to clearances within a controlled airspace. Other desirable features and characteristics of the methods and systems will become apparent from the subsequent detailed description and the appended claims, taken in conjunction with the accompanying drawings and the preceding background.

BRIEF SUMMARY

Aircraft systems and related operating methods are provided. In one embodiment, a computer-implemented method of detecting a potential ambiguity in a sequence of communications is provided. The method involves obtaining a clearance communication associated with a first source of the communication (such as an aircraft, an air traffic control system, or the like), obtaining another clearance communication associated with a different source (such as another aircraft), identifying a first conversational context associated with the first clearance communication, identifying a second conversational context associated with the second clearance communication, identifying a discrepancy between the clearance communications associated different sources based at least in part on the first and second conversational contexts, and in response to identifying the discrepancy, generating a user notification at one or more of the first source and the second source.

In another embodiment, a method of detecting a potential ambiguity in a sequence of communications involves receiving, at a first aircraft, a first clearance communication associated with a second aircraft different from the first aircraft, obtaining, at the first aircraft, a second clearance communication associated with the first aircraft, and determining, at the first aircraft, the first clearance communication is related to the second clearance communication based at least in part on a relationship between a first conversational context associated with the first clearance communication and a second conversational context associated with the second clearance communication. In response to determining the first clearance communication is related to the second clearance communication, the method continues by comparing, at the first aircraft, one or more fields associated with the first clearance communication with the one or more fields associated with the second clearance communication to identify a discrepancy between a first value for a first field (e.g., a runway, waypoint, altitude, heading, speed, or the like) of the one or more fields associated with the first clearance communication and a second value for a second field of the one or more fields associated with the second clearance communication and generating a user notification at the first aircraft in response to identifying the discrepancy.

An embodiment of an aircraft system is also provided. The aircraft system includes a communications system to obtain a plurality of clearance communications, a data storage element to maintain a table of entries corresponding to respective clearance communications of the plurality of clearance communications, a user interface, and a processing system coupled to the data storage element, the user interface and the communications system. The processing system is configurable to assign a conversational context corresponding to each respective clearance communication of the plurality of clearance communications to each respective entry in the table of entries, identify a discrepancy between a first entry associated with a first clearance communication of the plurality of clearance communications and a second entry associated with a second clearance communication of the plurality of clearance communications based at least in part on a first conversational context assigned to the first entry and a second conversational context assigned to the second entry, and generate a user notification via the user interface in response to the discrepancy.

Furthermore, other desirable features and characteristics of the subject matter described herein will become apparent from the subsequent detailed description and the appended claims, taken in conjunction with the accompanying drawings and the preceding background.

BRIEF DESCRIPTION OF THE DRAWINGS

The present invention will hereinafter be described in conjunction with the following figures, wherein like numerals denote like elements, and wherein:

FIG. 4 is a table depicting an exemplary sequence of clearance communications that may be obtained by a communications system and analyzed in accordance with the ambiguity detection process of FIG. 3 in accordance with one or more embodiments.

DETAILED DESCRIPTION

Figure 1:
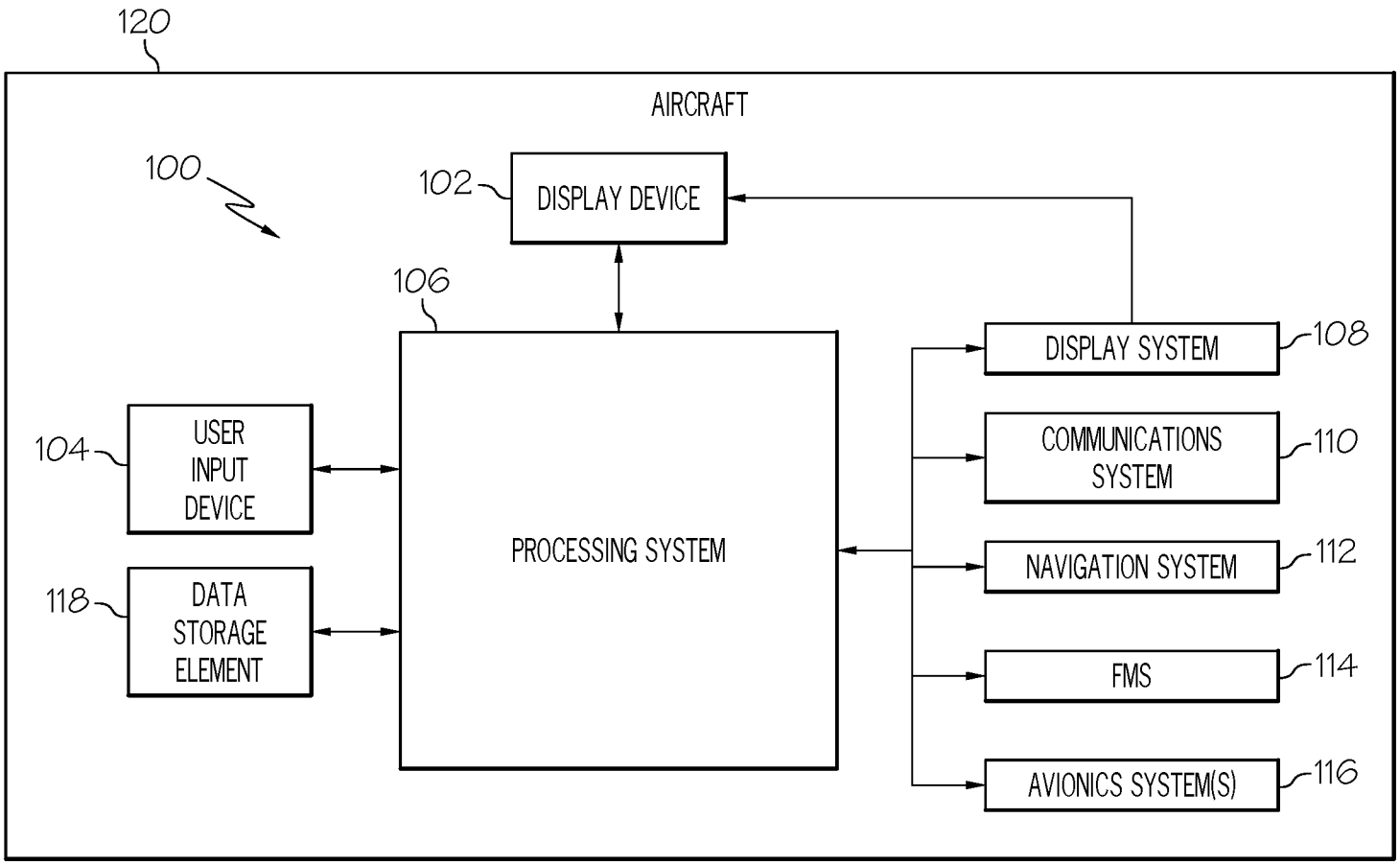
FIG. 1 is a block diagram illustrating an aircraft system in accordance with one or more exemplary embodiments.

The following detailed description is merely exemplary in nature and is not intended to limit the subject matter of the application and uses thereof. Furthermore, there is no intention to be bound by any theory presented in the preceding background, brief summary, or the following detailed description.

Embodiments of the subject matter described herein relate to systems and methods for detecting and mitigating potential ambiguities or uncertainties in clearance communications associated with different vehicles operating within a commonly controlled area. For purposes of explanation, the subject matter is primarily described herein in the context of aircraft operating in a controlled airspace; however, the subject matter described herein is not necessarily limited to aircraft or avionic environments, and in alternative embodiments, may be implemented in an equivalent manner for ground operations, marine operations, or otherwise in the context of other types of vehicles and travel spaces.

As described in greater detail below primarily in the context of FIGS. 2-5, in exemplary embodiments, clearance communications associated with different aircraft concurrently operating in a commonly controlled airspace (or alternatively airspaces that are not commonly controlled but adjacent or otherwise within a threshold distance of one another) are compared to one another and analyzed to identify one or more indications of a potential ambiguity or uncertainty in the communications sequence. In this regard, the subject matter described herein advantageously accounts for ambiguities or uncertainties that could otherwise go undetected as a result of noise, signal interference, human errors, shorthand or truncated terminology, and the like, such as, for example, an air traffic controller issuing an instruction with a nonexistent or amalgamated call sign, an air traffic controller incorrectly issuing an instruction for particular aircraft using a call sign of another aircraft, an incorrect acknowledgment by one aircraft to an instruction for another aircraft, or a clearance communication on an incorrect radio frequency or channel. In response to identifying a potential ambiguity or uncertainty between clearance communications for two different aircraft, a pilot, crewmember or other operator of at least one of the aircraft is notified of the potential issue. In one or more embodiments, contextual information associated with the clearance communications is utilized to compare one clearance communication with another clearance communication to identify a potential ambiguity. In this regard, a potential ambiguity may be identified based on conversational contexts (e.g., multiple responses to a given request, an out of order clearance communication, or the like) in conjunction with discrepancies (or a lack thereof) between operational parameters of different clearance communications (e.g., an incorrect call sign or other incorrect parameter within a clearance communication).

In exemplary embodiments, each clearance communication received or transmitted by a particular aircraft or air traffic control system associated with or otherwise operating within a commonly controlled airspace is associated with a particular aircraft identifier and assigned a conversational context that may be utilized to identify potentially related communications for analysis. In this regard, if the initial communication associated with a particular aircraft emanates from an air traffic control system, that communication may be assigned or tagged as being an air traffic control (ATC) instruction, while if the initial communication emanated from the aircraft, it may be assigned or tagged as being an aircraft request. A subsequent communication associated with that aircraft emanating from a different source may be designated as a response or acknowledgement to the preceding communication. The conversational contexts and associated aircraft identifiers (which depending on the scenario could be only partially recognized, missing, or incorrect) may be utilized to identify clearance communications that are likely to be responsive to one another, or are likely to pertain to a common preceding communication (e.g., when multiple aircraft respond to the same ATC instruction). For example, successive clearance communications associated with the same aircraft identifier may be identified as related to one another when their associated conversational contexts indicate they are likely to be responsive to one another (e.g., a pairing of a request or instruction from one source with a response from the other source). Similarly, successive clearance communications from different sources may be identified as potentially being related to one another when their associated conversational contexts indicate they are likely to be responsive to one another and operational parameters associated with the clearance communications match, or alternatively, when both their associated conversational contexts and operational parameters associated with the clearance communications match, indicating the communications are likely responsive to a common instruction or request.

For related clearance communications associated with the same aircraft identifier, the values for their associated radio frequencies or communications channels along with the values for their associated operational parameters are compared to one another to verify or otherwise validate the communications match or otherwise conform to one another. As a result, clearance communications that are responsive to one another but are inadvertently or incorrectly using different radio frequencies or communications channels may be detected and alerted to one or more of the parties to the communications, thereby mitigating any potential ambiguous situation or uncertainty regarding operation of the aircraft. Additionally, the clearance communications may also be validated or verified as lacking any hearing or read back errors when the operational parameters match.

For clearance communications associated with the different sources that are identified as potentially being related based on conversational contexts along with temporal contexts (e.g., being successive or within a threshold amount of time from one another) and/or operational contexts (e.g., matching operational parameters), the values for their associated aircraft identifiers are compared to one another to detect or otherwise identify usage of an incorrect call sign, call sign confusion, or the like. Similarly, their associated radio frequencies or communications channels may also be compared to identify inadvertent or incorrect usage of different radio frequencies or otherwise detect potentially ambiguous or uncertain operations between two aircraft in a commonly controlled airspace or operating in proximity of one another (e.g., within common or overlapping communications ranges).

In one or more embodiments, for each clearance communication, a corresponding clearance communication entry in a table or similar data structure is created that maintains an association between different pieces of contextual information associated with the particular clearance communication. For example, in one embodiment, a clearance communication entry in a clearance table maintains an association between the text of the clearance communication, one or more identifiers associated with the clearance communication (e.g., a flight identifier, call sign, or other aircraft identifier associated with the clearance communication), a radio frequency or communications channel associated with the clearance communication, an action associated with the clearance communication (e.g., landing, takeoff, pushback, hold, or the like), an operational subject of the clearance communication (e.g., a runway, a taxiway, a waypoint, a heading, an altitude, a flight level, or the like), and the values for one or more operational parameters contained in the clearance communication (e.g., the runway identifier, taxiway identifier, waypoint identifier, heading angle, altitude value, or the like). Each clearance communication entry may also include or otherwise maintain an association with the source of the clearance communication (e.g., ownship, air traffic control, or another aircraft). Each clearance communication entry may also be tagged or otherwise include a conversational context field that indicates whether its associated clearance communication is an aircraft request, an air traffic control (ATC) approval of a request, an ATC instruction, an aircraft response, or an unknown type of communication. Additionally, each clearance communication entry includes a timestamp corresponding to when the clearance communication was received, which, in turns, allows for the clearance table to be sorted or otherwise prioritized temporally. The clearance table may be further sorted or analyzed by one or more additional fields of the clearance communication entries (e.g., the aircraft identifier, radio frequency, operational subject, operational parameters, conversational context, and/or the like) that allows for the clearance communications to be analyzed across different contextualities as well as temporally to detect ambiguities or potential discrepancies that could otherwise go undetected.

FIG. 1 depicts an exemplary embodiment of a system 100 which may be utilized with a vehicle, such as an aircraft 120. In an exemplary embodiment, the system 100 includes, without limitation, a display device 102, one or more user input devices 104, a processing system 106, a display system 108, a communications system 110, a navigation system 112, a flight management system (FMS) 114, one or more avionics systems 116, and a data storage element 118 suitably configured to support operation of the system 100, as described in greater detail below.

In exemplary embodiments, the display device 102 is realized as an electronic display capable of graphically displaying flight information or other data associated with operation of the aircraft 120 under control of the display system 108 and/or processing system 106. In this regard, the display device 102 is coupled to the display system 108 and the processing system 106, wherein the processing system 106 and the display system 108 are cooperatively configured to display, render, or otherwise convey one or more graphical representations or images associated with operation of the aircraft 120 on the display device 102. The user input device 104 is coupled to the processing system 106, and the user input device 104 and the processing system 106 are cooperatively configured to allow a user (e.g., a pilot, co-pilot, or crew member) to interact with the display device 102 and/or other elements of the system 100, as described in greater detail below. Depending on the embodiment, the user input device(s) 104 may be realized as a keypad, touchpad, keyboard, mouse, touch panel (or touchscreen), joystick, knob, line select key or another suitable device adapted to receive input from a user. In some embodiments, the user input device 104 includes or is realized as an audio input device, such as a microphone, audio transducer, audio sensor, or the like, that is adapted to allow a user to provide audio input to the system 100 in a "hands free" manner without requiring the user to move his or her hands, eyes and/or head to interact with the system 100.

The processing system 106 generally represents the hardware, software, and/or firmware components configured to facilitate communications and/or interaction between the elements of the system 100 and perform additional tasks and/or functions to support operation of the system 100, as described in greater detail below. Depending on the embodiment, the processing system 106 may be implemented or realized with a general purpose processor, a content addressable memory, a digital signal processor, an application specific integrated circuit, a field programmable gate array, any suitable programmable logic device, discrete gate or transistor logic, processing core, discrete hardware components, or any combination thereof, designed to perform the functions described herein. The processing system 106 may also be implemented as a combination of computing devices, e.g., a plurality of processing cores, a combination of a digital signal processor and a microprocessor, a plurality of microprocessors, one or more microprocessors in conjunction with a digital signal processor core, or any other such configuration. In practice, the processing system 106 includes processing logic that may be configured to carry out the functions, techniques, and processing tasks associated with the operation of the system 100, as described in greater detail below. Furthermore, the steps of a method or algorithm described in connection with the embodiments disclosed herein may be embodied directly in hardware, in firmware, in a software module executed by the processing system 106, or in any practical combination thereof. For example, in one or more embodiments, the processing system 106 includes or otherwise accesses a data storage element (or memory), which may be realized as any sort of non-transitory short or long term storage media capable of storing programming instructions for execution by the processing system 106. The code or other computer-executable programming instructions, when read and executed by the processing system 106, cause the processing system 106 to support or otherwise perform certain tasks, operations, functions, and/or processes described herein.

The display system 108 generally represents the hardware, software, and/or firmware components configured to control the display and/or rendering of one or more navigational maps and/or other displays pertaining to operation of the aircraft 120 and/or onboard systems 110, 112, 114, 116 on the display device 102. In this regard, the display system 108 may access or include one or more databases suitably configured to support operations of the display system 108, such as, for example, a terrain database, an obstacle database, a navigational database, a geopolitical database, a terminal airspace database, a special use airspace database, or other information for rendering and/or displaying navigational maps and/or other content on the display device 102.

In exemplary embodiments, the aircraft system 100 includes a data storage element 118, which contains aircraft procedure information (or instrument procedure information) for a plurality of airports and maintains association between the aircraft procedure information and the corresponding airports. Depending on the embodiment, the data storage element 118 may be physically realized using RAM memory, ROM memory, flash memory, registers, a hard disk, or another suitable data storage medium known in the art or any suitable combination thereof.

As used herein, aircraft procedure information should be understood as a set of operating parameters, constraints, or instructions associated with a particular aircraft action (e.g., approach, departure, arrival, climbing, and the like) that may be undertaken by the aircraft 120 at or in the vicinity of a particular airport. As used herein, an airport should be understood as referring to a location suitable for landing (or arrival) and/or takeoff (or departure) of an aircraft, such as, for example, airports, runways, landing strips, and other suitable landing and/or departure locations, and an aircraft action should be understood as referring to an approach (or landing), an arrival, a departure (or takeoff), an ascent, taxiing, or another aircraft action having associated aircraft procedure information. Each airport may have one or more predefined aircraft procedures associated therewith, wherein the aircraft procedure information for each aircraft procedure at each respective airport may be maintained by the data storage element 118. The aircraft procedure information may be provided by or otherwise obtained from a governmental or regulatory organization, such as, for example, the Federal Aviation Administration in the United States. In an exemplary embodiment, the aircraft procedure information comprises instrument procedure information, such as instrument approach procedures, standard terminal arrival routes, instrument departure procedures, standard instrument departure routes, obstacle departure procedures, or the like, traditionally displayed on a published charts, such as Instrument Approach Procedure (IAP) charts, Standard Terminal Arrival (STAR) charts or Terminal Arrival Area (TAA) charts, Standard Instrument Departure (SID) routes, Departure Procedures (DP), terminal procedures, approach plates, and the like. In exemplary embodiments, the data storage element 118 maintains associations between prescribed operating parameters, constraints, and the like and respective navigational reference points (e.g., waypoints, positional fixes, radio ground stations (VORs, VORTACs, TACANs, and the like), distance measuring equipment, non-directional beacons, or the like) defining the aircraft procedure, such as, for example, altitude minima or maxima, minimum and/or maximum speed constraints, RTA constraints, and the like. It should be noted that although the subject matter is described below in the context of departure procedures and/or climbing procedures for purposes of explanation, the subject matter is not intended to be limited to use with any particular type of aircraft procedure and may be implemented for other aircraft procedures (e.g., approach procedures or en route procedures) in an equivalent manner.

Still referring to FIG. 1, in an exemplary embodiment, the processing system 106 is coupled to the navigation system 112, which is configured to provide real-time navigational data and/or information regarding operation of the aircraft 120. The navigation system 112 may be realized as a global positioning system (GPS), inertial reference system (IRS), or a radio-based navigation system (e.g., VHF omni-directional radio range (VOR) or long range aid to navigation (LORAN)), and may include one or more navigational radios or other sensors suitably configured to support operation of the navigation system 112, as will be appreciated in the art. The navigation system 112 is capable of obtaining and/or determining the instantaneous position of the aircraft 120, that is, the current (or instantaneous) location of the aircraft 120 (e.g., the current latitude and longitude) and the current (or instantaneous) altitude or above ground level for the aircraft 120. The navigation system 112 is also capable of obtaining or otherwise determining the heading of the aircraft 120 (i.e., the direction the aircraft is traveling in relative to some reference). In the illustrated embodiment, the processing system 106 is also coupled to the communications system 110, which is configured to support communications to and/or from the aircraft 120. For example, the communications system 110 may support communications between the aircraft 120 and air traffic control or another suitable command center or ground location. In this regard, the communications system 110 may be realized using a radio communication system and/or another suitable data link system.

In an exemplary embodiment, the processing system 106 is also coupled to the FMS 114, which is coupled to the navigation system 112, the communications system 110, and one or more additional avionics systems 116 to support navigation, flight planning, and other aircraft control functions in a conventional manner, as well as to provide real-time data and/or information regarding the operational status of the aircraft 120 to the processing system 106. Although FIG. 1 depicts a single avionics system 116, in practice, the system 100 and/or aircraft 120 will likely include numerous avionics systems for obtaining and/or providing real-time flight-related information that may be displayed on the display device 102 or otherwise provided to a user (e.g., a pilot, a co-pilot, or crew member). For example, practical embodiments of the system 100 and/or aircraft 120 will likely include one or more of the following avionics systems suitably configured to support operation of the aircraft 120: a weather system, an air traffic management system, a radar system, a traffic avoidance system, an autopilot system, an autothrust system, a flight control system, hydraulics systems, pneumatics systems, environmental systems, electrical systems, engine systems, trim systems, lighting systems, crew alerting systems, electronic checklist systems, an electronic flight bag and/or another suitable avionics system.

It should be understood that FIG. 1 is a simplified representation of the system 100 for purposes of explanation and ease of description, and FIG. 1 is not intended to limit the application or scope of the subject matter described herein in any way. It should be appreciated that although FIG. 1 shows the display device 102, the user input device 104, and the processing system 106 as being located onboard the aircraft 120 (e.g., in the cockpit), in practice, one or more of the display device 102, the user input device 104, and/or the processing system 106 may be located outside the aircraft 120 (e.g., on the ground as part of an air traffic control center or another command center) and communicatively coupled to the remaining elements of the system 100 (e.g., via a data link and/or communications system 110). Similarly, in some embodiments, the data storage element 118 may be located outside the aircraft 120 and communicatively coupled to the processing system 106 via a data link and/or communications system 110. Furthermore, practical embodiments of the system 100 and/or aircraft 120 will include numerous other devices and components for providing additional functions and features, as will be appreciated in the art. In this regard, it will be appreciated that although FIG. 1 shows a single display device 102, in practice, additional display devices may be present onboard the aircraft 120. Additionally, it should be noted that in other embodiments, features and/or functionality of processing system 106 described herein can be implemented by or otherwise integrated with the features and/or functionality provided by the FMS 114. In other words, some embodiments may integrate the processing system 106 with the FMS 114. In yet other embodiments, various aspects of the subject matter described herein may be implemented by or at an electronic flight bag (EFB) or similar electronic device that is communicatively coupled to the processing system 106 and/or the FMS 114.

Figure 2:
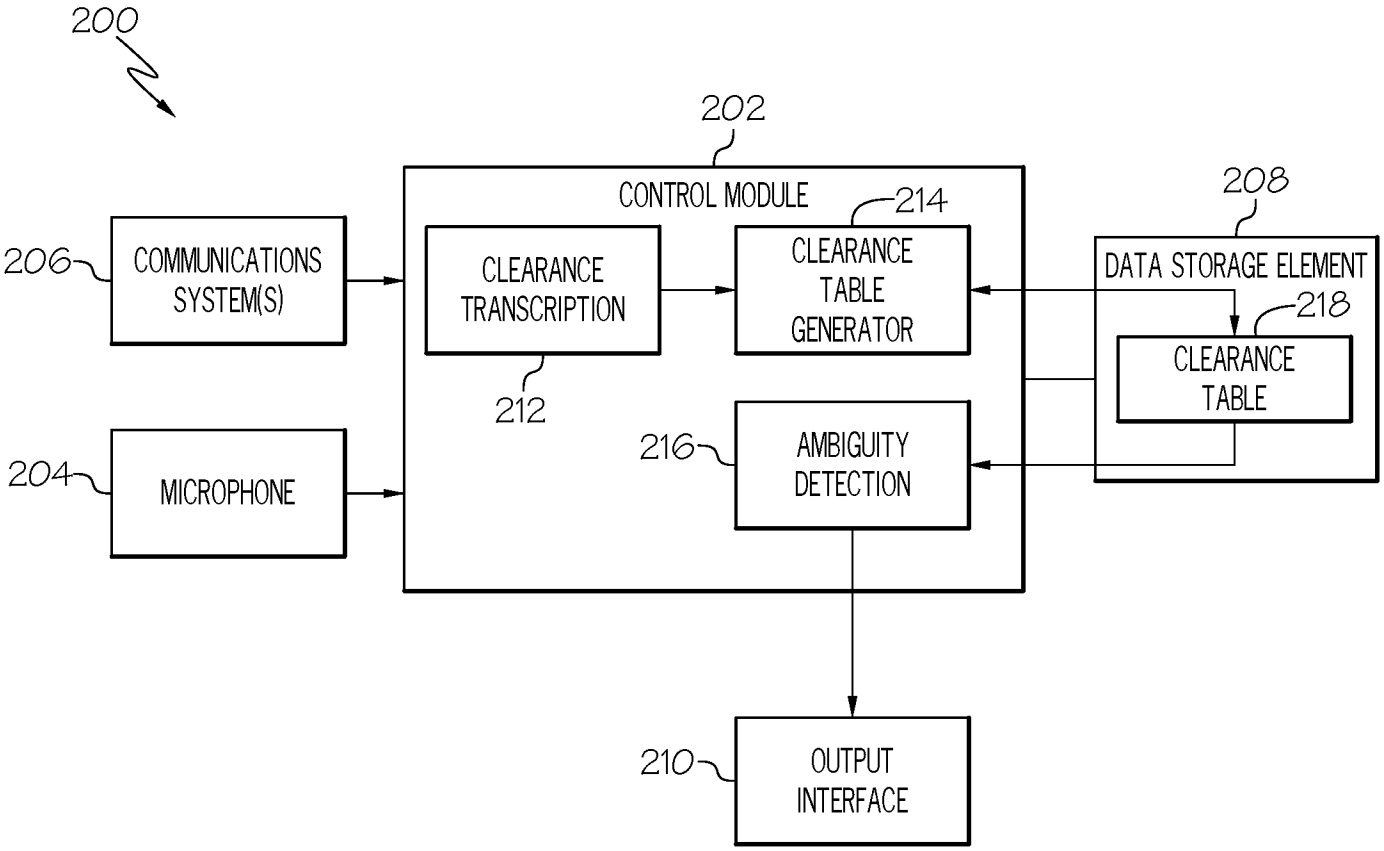
FIG. 2 is a block diagram illustrating a clearance ambiguity detection system suitable for use with the aircraft system of FIG. 1 in accordance with one or more exemplary embodiments.

FIG. 2 depicts an exemplary embodiment of a clearance ambiguity detection system 200 for detecting or identifying ambiguities or potential uncertainties between different clearance communications originating from different sources. In one or more exemplary embodiments, the clearance ambiguity detection system 200 is implemented or otherwise provided onboard a vehicle, such as aircraft 120; however, in alternative embodiments, the clearance ambiguity detection system 200 may be implemented independent of any aircraft or vehicle, for example, at a ground location such as an air traffic control facility. That said, for purposes of explanation, the clearance ambiguity detection system 200 may be primarily described herein in the context of an implementation onboard an aircraft. The illustrated clearance ambiguity detection system 200 includes a control module 202, an audio input device 204 (or microphone), one or more communications systems 206, a data storage element 208 (or memory), and one or more output user interfaces 210. It should be understood that FIG. 2 is a simplified representation of the clearance ambiguity detection system 200 for purposes of explanation and ease of description, and FIG. 2 is not intended to limit the application or scope of the subject matter described herein in any way.

The control module 202 generally represents the processing system of the clearance ambiguity detection system 200 and may include any sort of hardware, firmware, circuitry and/or logic components or combination thereof that is coupled to the microphone 204 and communications system(s) 206 to receive or otherwise obtain clearance communications and analyze the clearance communications to detect ambiguities or other potential uncertainties, as described in greater detail below. Depending on the embodiment, the control module 202 may be implemented or realized with a general purpose processor, a microprocessor, a controller, a microcontroller, a state machine, a content addressable memory, an application specific integrated circuit, a field programmable gate array, any suitable programmable logic device, discrete gate or transistor logic, discrete hardware components, or any combination thereof, designed to perform the functions described herein. In one or more embodiments, the control module 202 may be implemented as part of the processing system 106 onboard the aircraft 120 of FIG. 1. In exemplary embodiments, the control module 202 may also include or otherwise access a data storage element or memory (e.g., memory 208), including any sort of RAM, read only memory (ROM), flash memory, registers, hard disks, removable disks, magnetic or optical mass storage, or any other short or long term storage media or other non-transitory computer-readable medium, which is capable of storing programming instructions for execution by the control module 202. The computer-executable programming instructions, when read and executed by the control module 202, cause the control module 202 to perform or otherwise support the tasks, operations, functions, and processes described herein.

The audio input device 204 generally represents any sort of microphone, audio transducer, audio sensor, or the like capable of receiving voice or speech input at the location of the control module 202. In this regard, in one or more embodiments, the audio input device 204 is realized as a microphone 104 onboard the aircraft 120 to receive voice or speech annunciated by a pilot or other crewmember onboard the aircraft 120 inside the cockpit of the aircraft 120. The communications system(s) 206 (e.g., communications system 110) generally represent the avionics systems capable of receiving clearance communications from other sources, such as, for example, other aircraft, an air traffic controller, or the like. Depending on the embodiment, the communications system(s) 206 could include one or more of a very high frequency (VHF) radio communications system, a controller-pilot data link communications (CPDLC) system, an aeronautical operational control (AOC) communications system, an aircraft communications addressing and reporting system (ACARS), and/or the like.

In the illustrated embodiment, the computer-executable programming instructions executed by the control module 202 cause the control module 202 to generate, execute, or otherwise implement a clearance transcription application 212 capable of analyzing, parsing, or otherwise processing voice, speech, or other audio input received by the control module 202 to convert the received audio into a corresponding textual representation. In this regard, the clearance transcription application 212 may implement or otherwise support a speech recognition engine (or voice recognition engine) or other speech-to-text system. Accordingly, the control module 202 may also include various filters, analog-to-digital converters (ADCs), or the like, and the control module 202 or the data storage element 208 may store or otherwise a speech recognition vocabulary for use by the clearance transcription application 212 in converting audio inputs into transcribed textual representations. In one or more embodiments, the clearance transcription application 212 may also mark, tag, or otherwise associate a transcribed textual representation of a clearance communication with an identifier or other indicia of the source of the clearance communication (e.g., the onboard microphone 204, a radio communications system 206, or the like).

In the illustrated embodiment, the computer-executable programming instructions executed by the control module 202 also cause the control module 202 to generate, execute, or otherwise implement a clearance table generation application 214 (or clearance table generator) that receives the transcribed textual clearance communications from the clearance transcription application 212 or receives clearance communications in textual form directly from a communications system 206 (e.g., a CPDLC system). The clearance table generator 214 parses or otherwise analyzes the textual representation of the received clearance communications and generates corresponding clearance communication entries in a table 218 in the memory 208. In this regard, the clearance table 218 maintains all of the clearance communications received by the control module 202 from either the onboard microphone 204 or an onboard communications system 206.

As described above, in exemplary embodiments, for each clearance communication received by the clearance table generator 214, the clearance table generator 214 parses or otherwise analyzes the textual content of the clearance communication and attempts to extract or otherwise identify, if present, one or more of an identifier contained within the clearance communication (e.g., a flight identifier, call sign, or the like), an operational subject of the clearance communication (e.g., a runway, a taxiway, a waypoint, a heading, an altitude, a flight level, or the like), an operational parameter value associated with the operational subject in the clearance communication (e.g., the runway identifier, taxiway identifier, waypoint identifier, heading angle, altitude value, or the like), and/or an action associated with the clearance communication (e.g., landing, takeoff, pushback, hold, or the like). The clearance table generator 214 also identifies the radio frequency or communications channel associated with the clearance communication and attempts to identify or otherwise determine the source of the clearance communication. The clearance table generator 214 then creates or otherwise generates an entry in the clearance table 218 that maintains an association between the textual content of the clearance communication and the identified fields associated with the clearance communication. Additionally, the clearance table generator 214 may analyze the new clearance communication entry relative to existing clearance communication entries in the clearance table 218 to identify or otherwise determine a conversational context to be assigned to the new clearance communication entry.

Still referring to FIG. 2, in the illustrated embodiment, computer-executable programming instructions executed by the control module 202 also cause the control module 202 to generate, execute, or otherwise implement an ambiguity detection application 216 that analyzes the clearance communication entries in the clearance table 218 to detect or otherwise identify potential ambiguities, uncertainties, or conflicts between different clearance communications. As described in greater detail below, the ambiguity detection application 216 utilizes one or more of the conversational and temporal context information associated with different clearance communications to detect or otherwise identify a discrepancy indicative of a potential ambiguity, uncertainty, or conflict within the sequence of clearance communications maintained in the clearance table 218. In response to identifying such a discrepancy between related communications, the ambiguity detection application 216 generates or otherwise provides a user notification via one or more output user interface devices 210, such as, for example, a display device (e.g., display device 102), an audio output device, or the like. Additionally, in one or more embodiments, the ambiguity detection application 216 may transmit or otherwise provide notification to one or more other aircraft, an air traffic controller, or other device or system external to the clearance ambiguity detection system 200.

Figure 3:
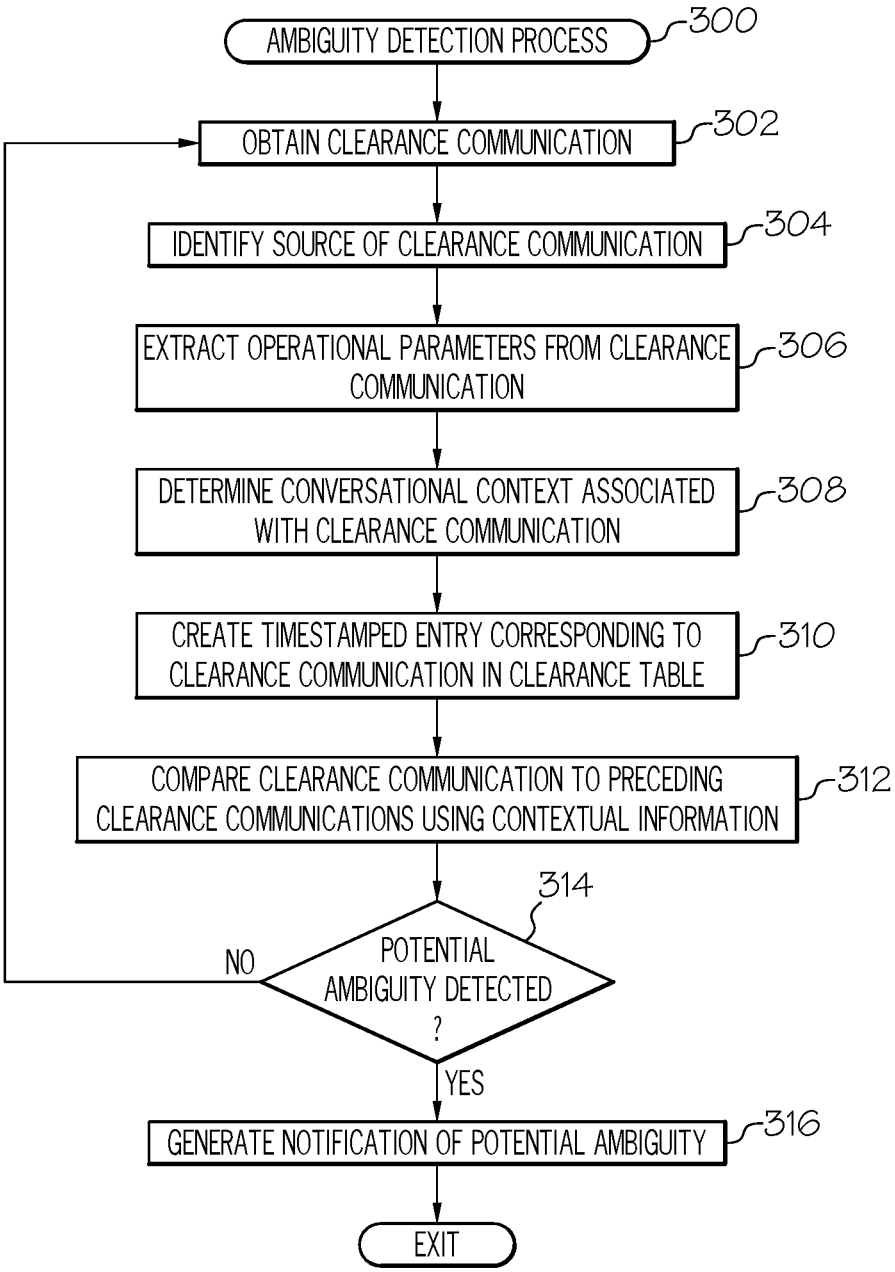
FIG. 3 is a flow diagram illustrating an ambiguity detection process suitable for implementation by the aircraft system of FIG. 1 or the clearance ambiguity detection system of FIG. 2 in accordance with one or more exemplary embodiments.

Referring now to FIG. 3, in an exemplary embodiment, an aircraft system is configured to support a clearance ambiguity detection process 300 and perform additional tasks, functions, and operations described below to detect or otherwise identify potential ambiguities or uncertainties within clearance communications when multiple aircraft are concurrently operating in a common controlled airspace. The various tasks performed in connection with the illustrated process 300 may be implemented using hardware, firmware, software executed by processing circuitry, or any combination thereof. For illustrative purposes, the following description may refer to elements mentioned above in connection with FIGS. 1-2. In practice, portions of the ambiguity detection process 300 may be performed by different elements of the aircraft system 100 or the clearance ambiguity detection system 200. That said, exemplary embodiments are described herein in the context of the ambiguity detection process 300 being primarily performed by the control module 202, which may be implemented as part of the processing system 106 and/or FMS 114 onboard the aircraft 120. It should be appreciated that the ambiguity detection process 300 may include any number of additional or alternative tasks, the tasks need not be performed in the illustrated order and/or the tasks may be performed concurrently, and/or the ambiguity detection process 300 may be incorporated into a more comprehensive procedure or process having additional functionality not described in detail herein. Moreover, one or more of the tasks shown and described in the context of FIG. 3 could be omitted from a practical embodiment of the ambiguity detection process 300 as long as the intended overall functionality remains intact.

In exemplary embodiments, the ambiguity detection process 300 is initiated when an aircraft 120 enters or otherwise begins operating in a controlled airspace or transfers from one airspace to another airspace. In this regard, in one or more embodiments, prior to initializing the ambiguity detection process 300, the control module 202 may remove or delete clearance communication entries pertaining to preceding operations of the aircraft 120 to effectuate clearing or otherwise resetting the clearance table 218 for the current operation in the controlled airspace.

The illustrated detection process 300 begins by receiving or otherwise obtaining a clearance communication and identifying or otherwise determining the source of the clearance communication (tasks 302, 304). Some clearance communications may be received as speech in an audio format by the processing system 106 and/or control module 202 from an audio input device 104, 204 onboard the aircraft 120 or a radio communications system 110, 206 onboard the aircraft 120. As described above, in such embodiments, the processing system 106 and/or control module 202 performs speech recognition to convert the audio input into a corresponding textual representation that may be stored or otherwise maintained in a clearance table 218 in a memory 118, 208. Additionally, the processing system 106 and/or control module 202 may identify the source of the clearance communication as coming from the aircraft 120 itself (or ownship) and tag or otherwise associated the clearance communication with the radio frequency or channel on which the ownship clearance communication is being transmitted. Other clearance communications are received from external sources, either in an audio format or a textual format, via an onboard communications system 110, 206 (e.g., a radio communications system, a CPDLC system, an AOC system, ACARS, or the like). Similarly, for such external clearance communications received in an audio format, the processing system 106 and/or control module 202 performs speech recognition to convert the audio input into a corresponding textual representation. The processing system 106 and/or control module 202 may identify the source of the clearance communication as an external source and tag or otherwise associated the clearance communication with the radio frequency or channel on which the external clearance communication was received, or which communications system provided the clearance communication. In some embodiments, the processing system 106 and/or control module 202 may analyze the radio frequency or communications system 110, 206 associated with the external clearance communication and/or the textual content of the external clearance communication to further classify the source of the communication as an air traffic controller, another aircraft, or the like.

The ambiguity detection process 300 continues by extracting operational parameters from the textual clearance communication (task 306). In this regard, the processing system 106 and/or control module 202 attempts to discretize or quantify the clearance communication across a number of different fields that may be utilized to characterize or otherwise define the operational context of the clearance communication. For example, as described above, in exemplary embodiments, the processing system 106 and/or control module 202 parses or otherwise analyzes the textual representation of the clearance communication to extract one or more of an aircraft identifier contained within the clearance communication (e.g., a flight identifier, call sign, or the like), an operational subject of the clearance communication (e.g., a runway, a taxiway, a waypoint, a heading, an altitude, a flight level, or the like), an operational parameter value associated with the operational subject in the clearance communication (e.g., the runway identifier, taxiway identifier, waypoint identifier, heading angle, altitude value, or the like), and an action associated with the clearance communication (e.g., landing, takeoff, pushback, hold, or the like). The extracted fields of the clearance communication may then be utilized to characterize or otherwise define the operational context of the clearance communication.

In exemplary embodiments, the ambiguity detection process 300 also identifies or otherwise determines the conversational context associated with the clearance communication (task 308). In this regard, the processing system 106 and/or control module 202 may analyze preceding clearance communications in the clearance table 218 and the source of the clearance communication to classify or otherwise determine whether the clearance communication is a request or instruction, a response or acknowledgment, or a communication of an unknown or unassociated type. For example, using the flight identifier or call sign associated with the clearance communication, the clearance table generator 214 may query or otherwise search the clearance table 218 for previous clearance communication entries associated with that same aircraft identifier. In the absence of any preceding clearance communications associated with that aircraft, the clearance table generator 214 may determine that the clearance communication is a request (or an instruction), depending on the source of the clearance communication. When there are preceding clearance communications associated with that aircraft, the clearance table generator 214 may determine the conversational context based on the preceding clearance communications. For example, if the most recent clearance communication associated with that aircraft is a request from a different source than the current source, the clearance table generator 214 may determine the current clearance communication is a response. Conversely, if the most recent clearance communication associated with that aircraft is a response from a different source than the current source, then the clearance table generator 214 may determine the current clearance communication is a request. If the most recent clearance communication associated with that aircraft is from the same source as the current clearance communication, the clearance table generator 214 may assign the current clearance communication as being an unknown type of communication.

The ambiguity detection process 300 continues by creating, instantiating, or otherwise generating a timestamped clearance communication entry corresponding to the current clearance communication in a table or similar data structure in a data storage element (task 310). In this regard, the clearance communication entry maintains an association between the conversational context assigned to the clearance communication, the operational context parameters extracted from the clearance communication, the source of the clearance communication, and the textual representation of the clearance communication. In exemplary embodiments, the clearance table 218 also includes a timestamp field that allows the clearance communication entry to be tagged or otherwise marked with a time of receipt, thereby allowing the clearance communication entries in the clearance table 218 to be sorted, ordered, or prioritized temporally.

After creating an entry in the clearance table, the ambiguity detection process 300 continues by comparing or otherwise analyzing the clearance communication entry with respect to related clearance communication entries preceding the current clearance communication entry based on the contextual information associated with the current clearance communication entry to detect or otherwise identify a discrepancy indicative of a potential ambiguity in the sequence of clearance communications (tasks 312, 314). In this regard, the ambiguity detection application 216 at the processing system 106 and/or control module 202 utilizes the conversational context, the temporal context, and/or the operational context associated with the clearance communication to identify related clearance communication entries that precede the current clearance communication based on certain commonalities between the clearance communications. In this regard, the conversational context and one or more of a temporal context or an operational context may be utilized to identify clearance communications that are likely related, for example, based on their successive occurrence or otherwise occurring within a threshold time period of one another, or based on the clearance communications referencing common operational subjects, corresponding to the same action, or the like. The related clearance communication entries are then compared to the current clearance communication entry to identify potential discrepancies or mismatches between clearance communications that could be indicative of an ambiguity. An ambiguity, an ambiguous situation, or variants thereof should be understood as referring to a situation where operation of the aircraft could deviate from the desired controlled operation or instructions provided by an air traffic controller or a situation where operations of two different aircraft could potentially conflict with one another but without the deviation or conflict being evident in the content of the clearance communications associated with the individual aircraft.

In response to identifying a discrepancy between contextually related clearance communications, the ambiguity detection process 300 generates or otherwise provides a user notification alerting one or more users to the potential ambiguity (task 316). For example, the processing system 106 and/or control module 202 may generate or otherwise provide a graphical indication of the potential ambiguity on a display device 102, 210 onboard the aircraft. Additionally or alternatively, the processing system 106 and/or control module 202 may generate or otherwise provide an auditory notification via an audio output device 210. Additionally, in some embodiments, the processing system 106 and/or control module 202 may transmit or otherwise provide a message to an ATC system or another aircraft that is utilized to generate a user notification of a potential ambiguity at the ATC system or onboard that other aircraft. In this regard, for an ambiguity in communications from two different aircraft may result in notifications being provided to both aircraft, while an ambiguity in communications between ATC and an aircraft may be provided to both ATC and that aircraft without unnecessarily notifying unaffected aircraft.

In one or more embodiments, the ambiguity detection application 216 at the processing system 106 and/or control module 202 analyzes clearance communications associated with a particular aircraft as well as clearance communications across different aircraft. For example, the ambiguity detection application 216 may first utilize the conversational context associated with the most recent clearance communication entry to determine whether or how to compare the clearance communication to a preceding clearance communication entry associated with the aircraft 120. Using the aircraft identifier associated with the current clearance communication entry, the ambiguity detection application 216 may search or query the clearance table 218 for preceding clearance communication entries associated with the same aircraft identifier, and then utilize the associated timestamps to identify the clearance communication associated with the aircraft 120 that immediately precedes the current clearance communication entry. The ambiguity detection application 216 may then analyze the conversational context to determine whether there is a conversational relationship between the successive clearance communication entries. For example, if the current clearance communication entry is a response and the immediately preceding clearance communication entry associated with the aircraft 120 is classified as a request or unknown communication, the ambiguity detection application 216 may proceed with comparing one or more other fields of the clearance communication entries to identify any discrepancies or mismatches. If one or more of the fields of the successive clearance communication entries for the aircraft do not match, the ambiguity detection application 216 determines a potential ambiguity exists. Conversely, if the current clearance communication entry is a request and the immediately preceding clearance communication entry associated with the aircraft 120 is classified as a response or unknown communication, the ambiguity detection application 216 may forego further comparison of the clearance communications because the request is not expected to match the preceding communication.

As described in greater detail below in the context of FIGS. 4-5, in addition to analyzing clearance communications associated with the aircraft 120, the current clearance communication entry is also analyzed with respect to conversationally and temporally relevant clearance communication entries associated with other aircraft to detect or otherwise potential ambiguities or conflicts between operations of the different aircraft. In this regard, the ambiguity detection application 216 may detect situations where more than one aircraft respond to a particular air traffic control (ATC) instruction, or where an aircraft responds to an instruction intended for another aircraft or an otherwise erroneous instruction, for example, when the ATC instruction uses an incorrect call sign or there is call sign confusion by one of the pilots. For example, if the current clearance communication entry is a response or unknown communication that does not have a matching or counterpart request associated with the same aircraft, the ambiguity detection application 216 may compare the current clearance communication entry to one or more preceding clearance communication entries that are also characterized as a response or unknown communication to verify a potential ambiguity does not exist between two different aircraft.

Still referring to FIG. 3, the loop defined by tasks 302, 304, 306, 308, 310, 312 and 314 may repeat throughout operation of the aircraft 120 within a controlled airspace to continuously monitor communications transmitted or received by the aircraft 120 for potential ambiguities. In this regard, subsequent clearance communications may be utilized to inform or update conversational contexts associated with preceding communications. For example, when two successive otherwise unknown clearance communications associated with a common aircraft identifier match across other operational context parameters, the entry for the earlier of the clearance communications may be updated and reclassified or tagged as a request, with the entry for the later of the clearance communications being updated and reclassified or tagged as a response. Similarly, when two successive clearance communications associated with a common aircraft identifier have matching subjects or other parameters, fields of one clearance communication entry may be utilized to complete or update another communication entry. For example, if the earlier of two communications associated with a given aircraft that otherwise match specifies a runway identifier while the latter of the communications references a runway without specifying the runway identifier, the ambiguity detection process 300 may update or augment the latter communication entry with the runway identifier value of the earlier communication.

One scenario the ambiguity detection process 300 is capable of mitigating is call sign confusion where the air traffic controller utilizes a shortened or truncated call sign, does not clearly annunciate the call sign, fails to utilize the call sign, or noise, congestion, or other signal interference prevent the call sign from being correctly received by one or more aircraft in its entirety. This, in turn, could result in an aircraft acknowledging or responding to an instruction or approval intended for another aircraft, or in some instances, multiple aircraft responding to the same instruction. It should be noted that these types of ambiguity may go undetected by approaches that check for read-back errors, because the read-back by a pilot may match all of the operational parameters of the previously received clearance communication, or could otherwise be consistent and make sense within the context of the preceding clearance communications involving that aircraft. In this regard, FIG. 4 depicts a simplified representation of a sequence 400 of clearance communications in a tabular format prioritized or ordered temporally in a sequential manner (e.g., using their associated time stamps) and secondarily ordered or arranged by aircraft identifier.

The clearance communications sequence 400 begins with ATC issuing an instruction or request that a first aircraft with a call sign JZA-269 utilize a standard instrument departure (SID) route "Richmond 1." As described above, a corresponding timestamped clearance communication entry associated with the ATC instruction may be created to maintain an association between an identifier indicating the ATC as the source, the radio frequency or communications channel associated with the ATC instruction, the type of communication as a request, JZA-269 as the aircraft identifier associated with the communication, a standard information departure route as the subject or object of the communication, and "Richmond 1" as the parameter value for the SID.

Subsequently, the ATC may assign a SID of "Georgia 2" to another aircraft with a call sign WS-628, clear the aircraft to lineup with runway 26L, and advise the aircraft to be second for departure. A corresponding timestamped clearance communication entry associated with the ATC instruction may be created to maintain an association between an identifier indicating the ATC as the source, the radio frequency or communications channel associated with the ATC instruction, the type of communication as a request, WS-628 as the aircraft identifier associated with the communication, a standard information departure route as one subject or object of the communication, and "Georgia 2" as the parameter value for the SID, a runway as another subject or object of the communication, and "26L" as the parameter value for the runway identifier. Based on the successive clearance communications both being requests that do not otherwise match with aircraft identifiers or have other matching or potentially conflicting operational parameters, the ambiguity detection process 300 does not detect an ambiguity.

Thereafter, the ATC clears another aircraft (WS-2057) for final approach to runway 26L. Subsequently, the ATC issues a clearance for runway 26L and for the "Richmond 1" SID, however, due to an error (e.g., human error, signal interference, or the like), the clearance is received with an amalgamated call sign that blends aspects of the other aircraft call signs. For example, due to a high volume of air traffic, confusion, stress, or the like, the ATC, in attempting to instruct one of the JZA-269 or WS-208 aircraft may inadvertently issue the desired instruction with the wrong call sign or a confusing call sign. As another example, due to channel congestion, noise, or other signal interference, the ATC may issue the instruction correctly but may be received or perceived incorrectly at the aircraft and/or be recognized incorrectly by the speech recognition engine onboard an aircraft (e.g., due to noisy and/or jumbled audio).

Due to the similarity in the received call sign number and the common SID, the pilot of JZA-269 may issue a clearance communication acknowledging the erroneous or ambiguous clearance. Here, it should be noted that this acknowledgment from JZA-269 does not exhibit any mismatch, conflict, or otherwise have any inherent inconsistencies with the initial communication from the ATC assigning JZA-269 Richmond 1, and therefore, may go undetected using read-back monitoring techniques. Similarly, the pilot of WS-628 may acknowledge the clearance, for example, based on the similarities in the aircraft identifier, the common runway being identified, failure to hear the different SID or assuming a change in SID, by virtue of being previously cleared to lineup with runway 26L and/or by virtue of construing the clearance for WS-2057 to approach runway 26L as a clearance for the departure preceding WS-628. Again, this acknowledgment from WS-628 does not mismatch, conflict, or otherwise have any inherent inconsistencies with the initial communication from the ATC clearing WS-628 to lineup with runway 26L, and also may go undetected using read-back monitoring techniques. However, as described below, by virtue of the ambiguity detection process 300 utilizing conversational and temporal context to identify potentially related clearance communications, the ambiguous and potentially uncontrolled situation may be detected and mitigated to avoid potential incursions, failure to maintain separation distances, etc.

For example, with respect to the acknowledgment by JZA-269, the clearance communication may be determined to be a response (e.g., task 308) either by virtue of the term "Roger" in the communication or by virtue of the preceding communication associated with the JZA-269 identifier being a request from ATC. A corresponding timestamped clearance communication entry associated with the response may be created to maintain an association between an identifier indicating JZA-269 as the source, the radio frequency or communications channel associated with the response, the type of communication as a response, JZA-269 as the aircraft identifier associated with the communication, a runway as the subject or object of the communication, and 26L as the value for the runway. The ambiguity detection application 216 then utilizes the conversational and temporal context associated with the communication to identify potentially related clearance communications for analysis. For example, based on the conversational context being a response, the ambiguity detection application 216 may search or query the clearance table 218 to obtain and identify whether a preceding clearance communication entry associated with JZA-269 is a request or unknown communication from the ATC or another source, and if so, verify there are no discrepancies or mismatches between the response and the preceding request.

For the illustrated sequence 400, after verifying there are no discrepancies or mismatches relative to the preceding clearance communication associated with aircraft JZA-269, the ambiguity detection application 216 then utilizes the conversational and temporal context associated with the communication and the subject or other operational context parameters associated with the communication to identify potentially related communications and determine whether there are any potential ambiguities in the communications sequence 400. For example, based on the clearance communication being a response for runway 26L, the ambiguity detection application 216 may search or query the clearance table 218 to obtain and identify whether operational parameters associated with the preceding request or unknown communication contained within the sequence 400 match the current clearance communication. In a similar manner, the ambiguity detection application 216 may search or query the clearance table 218 to identify whether operational parameters associated with a preceding response communication contained within the sequence 400 match the current clearance communication, thereby indicating another aircraft potentially responding to the same ATC instruction. In this regard, the ambiguity detection application 216 looks for discrepancies or mismatches in the aircraft identifier associated a preceding clearance communication associated with a different aircraft, which could otherwise go undetected (e.g., by virtue of the communication being associated with a different aircraft for read back analysis techniques). In this instance, the ambiguity detection application 216 identifies the preceding clearance communication in the sequence 400 associated with WJA-269 as a request associated with the common runway and detects or otherwise identifies a potential ambiguity based on the discrepancy in the aircraft identifier, even though there is no read back error by the pilot of JZA-269. In response, the ambiguity detection application 216 may generate a notification onboard JZA-269 (e.g., via output device 210) and/or provide a notification to the ATC system.

In a similar manner, with respect to the acknowledgment by WS-208, the ambiguity detection process 300 results in a corresponding timestamped clearance communication entry associated with the response may be created to maintain an association between an identifier indicating WS-208 as the source, the radio frequency or communications channel associated with the response, the type of communication as a response, WS-208 as the aircraft identifier associated with the communication, and a runway as the subject or object of the communication. In some embodiments, 26L may also be set as the value for the runway based on the preceding clearance communication associated with WS-208 referencing runway 26L. In a similar manner as described above, the ambiguity detection application 216 then utilizes the conversational and temporal context associated with the communication to identify potentially related clearance communications for analysis. For example, based on the conversational context being a response, the ambiguity detection application 216 may search or query the clearance table 218 to obtain and identify whether a preceding clearance communication entry associated with WS-208 is a request or unknown communication from the ATC or another source, and if so, verify there are no discrepancies or mismatches between the response and the preceding request.

For the illustrated sequence 400, after verifying there are no discrepancies or mismatches relative to the preceding clearance communication associated with aircraft WS-208, the ambiguity detection application 216 then utilizes the conversational and temporal context associated with the communication and the subject or other operational context parameters associated with the communication to identify potentially related communications and determine whether there are any potential ambiguities in the communications sequence 400 with respect to the response from aircraft WS-208. For example, based on the clearance communication being a response for runway 26L, the ambiguity detection application 216 may search or query the clearance table 218 to obtain and identify the preceding request associated with runway 26L being associated with the WJA-269 aircraft identifier, and detect a potential ambiguity based on discrepancy in the aircraft identifiers between successive requests and responses within a threshold period of time that pertain to the common runway 26L. In response, the ambiguity detection application 216 may generate a notification onboard WS-208 (e.g., via output device 210) and/or provide a notification to the ATC system. Similarly, the ambiguity detection application 216 may search or query the clearance table 218 to obtain and identify the preceding response associated with runway 26L being associated with the JZA-269 aircraft identifier, and detect a potential ambiguity based on discrepancy in the aircraft identifiers between successive responses occurring within a threshold period of time that pertain to a common runway 26L. In such a scenario where an ambiguity is detected between two aircraft-initiated communications (e.g., two aircraft responding to the same instruction from ATC), the ambiguity detection application 216 may generate a notification onboard WS-208 (e.g., via output device 210) and also transmit or otherwise provide a corresponding notification to the JZA-269 aircraft in addition to the ATC system. For example, in one embodiment, the ambiguity detection application 216 may initiate a broadcast of a notification of a potential ambiguity across the common radio frequency or communication channel associated with the communications, thereby attempting to notify all operators in the controller airspace who are communicating on that frequency.

Figure 5:
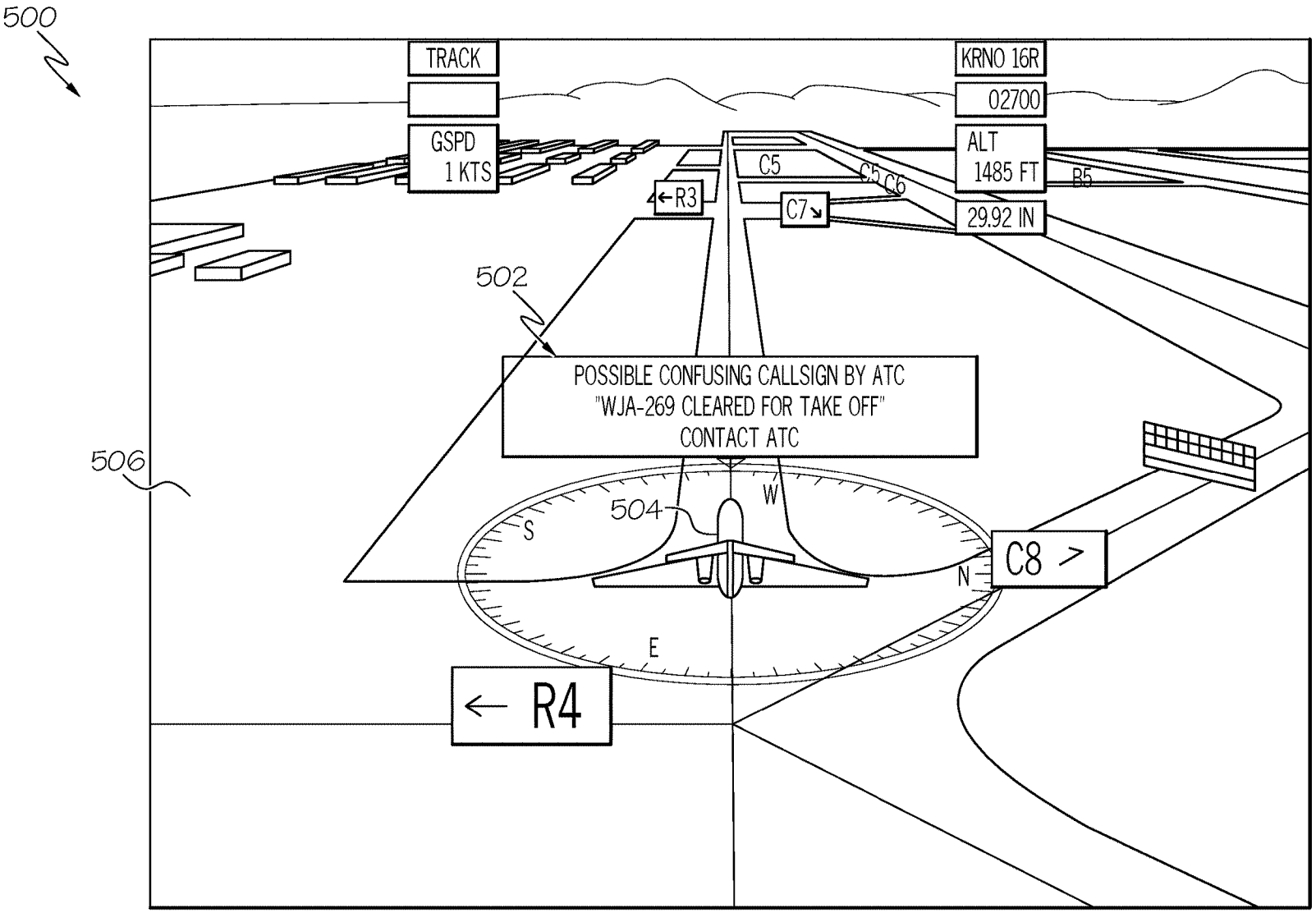
FIG. 5 is a graphical user interface (GUI) display that may be presented on a display device in the aircraft system of FIG. 1 or the clearance ambiguity detection system of FIG. 2 that includes a user notification of a potential ambiguity detected in accordance with one or more exemplary embodiments of the ambiguity detection process of FIG. 3.

FIG. 5 depicts an exemplary embodiment of a graphical user interface (GUI) display 500 that may be presented on a display device 102, 210 onboard an aircraft 120 that includes a graphical notification 502 of a potential ambiguity detected by the ambiguity detection process 300. In this regard, the GUI display 500 utilizes a perspective view that depicts a graphical representation 504 of the aircraft 120 overlying a terrain background 506, which corresponds to the airport surface or tarmac when the aircraft 120 is on the ground. In the illustrated embodiment, the ambiguity notification 502 includes a textual representation of the discrepancy detected by the ambiguity detection process 300, such as, for example, a mismatched aircraft identifier between the aircraft's response and a preceding request or instruction from the ATC that utilized a different aircraft identifier but for a common subject, action, or other common operating parameter. In some embodiments, the ambiguity detection process 300 may analyze the entire sequence of communications in the clearance table 218 to determine a probable or likely cause of the ambiguity based on the sequence of communications and generate a notification of the probable cause. In yet other embodiments, the ambiguity detection process 300 may analyze the entire sequence of communications in the clearance table 218 to determine a potential remedial action based on the discrepancy or cause of the ambiguity, and then generate or otherwise provide indication of the remedial action to be taken by the aircraft operator, ATC, or the like.

In addition to call sign confusion or other ambiguities caused by human error, noise, congestion, or the like, the ambiguity detection process 300 is also capable of detecting or identifying ambiguous situations where an aircraft is communicating on a different radio frequency or communications channel than the ATC for the controlled airspace that is intended to be responsible for controlling that aircraft. For example, a pilot could switch over to a ground frequency or an approach frequency without a handoff from the tower controller, or switch over from the ground frequency to the tower frequency without a handoff from the ground controller. In such situations, one of the pilot or the controller may be attempting to communicate with the other party with the expectation they are also communicating on the same frequency but unaware of the frequency discrepancy. In this regard, based on the conversational contexts associated with successive clearance communications associated with a particular aircraft indicating the later of the clearance communications is intended to be responsive to the earlier of the communications (e.g., when the earlier communication is a request or instruction and the subsequent communication is an approval or a response), the ambiguity detection application 216 identifies the clearance communications as being related and analyzes one or more fields of their associated entries in the clearance table 218 to identify any discrepancies or mismatched. Thus, when the radio frequency or communications channel associated with the later clearance communication is different from the radio frequency or communications channel associated with the earlier clearance communication, the ambiguity detection application 216 may generate or otherwise provide a user notification indicating a potential ambiguity exists based on the difference in radio frequencies. Again, it should be noted that the actual content of such communications may be devoid of any mismatch or errors, such that the ambiguous situation would be undetected if solely the content of the communications were being monitored for read-back or call sign errors. Detection of potential ambiguities resulting from erroneous or unintentional use of different communication channels may be particularly advantageous in situations where a high volume of air traffic exists or where multiple aircraft having similar call signs are operating concurrently, as the absence of a response or acknowledgment by an aircraft could go undetected by an air traffic controller.

The ambiguity detection process 300 is also capable of detecting ambiguities resulting from the ATC using the incorrect call sign when responding to an aircraft. For example, if an aircraft initiates a request that is approved by the ATC using a different call sign, the aircraft may delay operation waiting for a response from the ATC that is unlikely to be provided by virtue of the ATC believing the request has already been responded to. In this regard, similar to the call sign confusion examples described above, the ambiguity detection process 300 may detect a response or approval from the ATC that is associated with a different aircraft identifier but is relevant to the request by another aircraft contextually (e.g., responsive to the request), temporally (e.g., based on the timestamp difference being less than a threshold amount of time after the request), and operationally (e.g., based on common or matching operational parameters), and in response, notify one of the aircraft or the ATC to remedy the ambiguous situation. It should be noted that a potential ambiguity can also be detected by virtue of the clearance sequence lacking a preceding request associated with the incorrect call sign that the ATC approval would otherwise be responsive to. Thus, an air traffic controller could be apprised of usage of an incorrect call sign without delay or waiting for the pilot to reinitiate the request.

By using conversational contexts associated with different clearance communications to identify potentially related clearance communications that are potentially responsive to one another or potentially duplicative of one another across different aircraft or radio frequencies, ambiguous or uncertain situations that could otherwise go undetected when solely monitoring the content of the communications may be detected and mitigated, thereby maintaining more effective control of the airspace. In this regard, the subject matter described herein allows for detection of an aircraft or ATC system utilizing an incorrect radio frequency or communications channel, an incorrect call sign or other call sign confusion, or one or more aircraft responding to an instruction intended for a different aircraft.

For the sake of brevity, conventional techniques related to air traffic control, aviation communications, aviation terminology, flight management, route planning and/or navigation, aircraft procedures, aircraft controls, and other functional aspects of the systems (and the individual operating components of the systems) may not be described in detail herein. Furthermore, the connecting lines shown in the various figures contained herein are intended to represent exemplary functional relationships and/or physical couplings between the various elements. It should be noted that many alternative or additional functional relationships or physical connections may be present in an embodiment of the subject matter.

The subject matter may be described herein in terms of functional and/or logical block components, and with reference to symbolic representations of operations, processing tasks, and functions that may be performed by various computing components or devices. It should be appreciated that the various block components shown in the figures may be realized by any number of hardware components configured to perform the specified functions. For example, an embodiment of a system or a component may employ various integrated circuit components, e.g., memory elements, digital signal processing elements, logic elements, look-up tables, or the like, which may carry out a variety of functions under the control of one or more microprocessors or other control devices. Furthermore, embodiments of the subject matter described herein can be stored on, encoded on, or otherwise embodied by any suitable non-transitory computer-readable medium as computer-executable instructions or data stored thereon that, when executed (e.g., by a processing system), facilitate the processes described above.

The foregoing description refers to elements or nodes or features being "coupled" together. As used herein, unless expressly stated otherwise, "coupled" means that one element/node/feature is directly or indirectly joined to (or directly or indirectly communicates with) another element/node/feature, and not necessarily mechanically. Thus, although the drawings may depict one exemplary arrangement of elements, additional intervening elements, devices, features, or components may be present in an embodiment of the depicted subject matter. In addition, certain terminology may also be used in the following description for the purpose of reference only, and thus are not intended to be limiting. For example, terms such as "first," "second," and other such numerical terms may be utilized to refer to or distinguish between different elements or structures without implying a sequence or order unless indicated by the context.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the subject matter in any way. Rather, the foregoing detailed description will provide those skilled in the art with a convenient road map for implementing an exemplary embodiment of the subject matter. It should be understood that various changes may be made in the function and arrangement of elements described in an exemplary embodiment without departing from the scope of the subject matter as set forth in the appended claims. Accordingly, details of the exemplary embodiments or other limitations described above should not be read into the claims absent a clear intention to the contrary.

What is claimed is:

1. A computer-implemented method comprising:

obtaining a first clearance communication associated with an aircraft;

obtaining a second clearance communication associated with an air traffic control system;

identifying a first conversational context associated with the first clearance communication;

identifying a second conversational context associated with the second clearance communication;

identifying a discrepancy between the first clearance communication and the second clearance communication based at least in part on the first conversational context and the second conversational context, wherein identifying the discrepancy comprises:

determining the first clearance communication and the second clearance communication are related based on a relationship between the first conversational context and the second conversational context; and identifying the discrepancy between a first value of a parameter associated with the first clearance communication and a second value of the parameter associated with the second clearance communication; and in response to identifying the discrepancy, generating a user notification at one of the aircraft and the air traffic control system.

2. The method of claim 1, wherein identifying the discrepancy comprises identifying an incorrect radio frequency or an incorrect communications channel associated with one of the first clearance communication and the second clearance communication.

3. The method of claim 1, wherein identifying the discrepancy comprises identifying an incorrect call sign associated with one of the first clearance communication and the second clearance communication.

4. The method of claim 1, further comprising determining one of the first clearance communication and the second clearance communication is responsive to the other of the first clearance communication and the second clearance communication based on a relationship between the first conversational context and the second conversational context prior to identifying the discrepancy, wherein identifying the discrepancy comprises verifying one or more operational parameters associated with the first clearance communication match the one or more operational parameters associated with the second clearance communication.

5. The method of claim 1, wherein identifying the discrepancy comprises identifying a first radio frequency associated with the first clearance communication is different from a second radio frequency associated with the second clearance communication when one of the first clearance communication and the second clearance communication is responsive to the other of the first clearance communication and the second clearance communication based on a relationship between the first conversational context and the second conversational context.

6. The method of claim 1, wherein identifying the discrepancy comprises identifying a first aircraft identifier associated with the first clearance communication is different from a second aircraft identifier associated with the second clearance communication when one of the first clearance communication and the second clearance communication is responsive to the other of the first clearance communication and the second clearance communication based on a relationship between the first conversational context and the second conversational context.

7. The method of claim 1, wherein identifying the discrepancy comprises:

determining the first clearance communication and the second clearance communication are related based at least in part on a relationship between the first conversational context and the second conversational context; and identifying the discrepancy between the first aircraft identifier associated with the first clearance communication and the second aircraft identifier associated with the second clearance communication.

8. The method of claim 7, wherein determining the first clearance communication and the second clearance communication are related comprises determining the first clearance communication and the second clearance communication are related when the first conversational context matches the second conversational context and one or more operational parameter fields associated with the first clearance communication match the one or more operational parameter fields associated with the second clearance communication.

9. A method comprising:

receiving a first clearance communication from a first aircraft at a second aircraft, the second aircraft transmitting a second clearance communication;

obtaining the second clearance communication associated with the second aircraft;

identifying a first conversational context associated with the first clearance communication;

identifying a second conversational context associated with the second clearance communication;

identifying a discrepancy between the first clearance communication and the second clearance communication based at least in part on the first conversational context and the second conversational context by identifying one of the first aircraft and the second aircraft responding to an instruction for the other of the first aircraft and the second aircraft when the first conversational context matches the second conversational context; and in response to identifying the discrepancy, generating a user notification at one of the first aircraft and the second aircraft.

10. A method comprising:

receiving, at a first aircraft, a first clearance communication associated with a second aircraft different from the first aircraft;

obtaining, at the first aircraft, a second clearance communication associated with the first aircraft;

determining the first clearance communication and the second clearance communication are successive in a sequence of communications based at least in part on a first timestamp associated with the first clearance communication and a second timestamp associated with the second clearance communication;

determining the first clearance communication is related to the second clearance communication when the first conversational context matches the second conversational context after determining the first clearance communication and the second clearance communication are successive; and in response to determining the first clearance communication is related to the second clearance communication:

comparing, at the first aircraft, one or more fields associated with the first clearance communication with the one or more fields associated with the second clearance communication to identify a discrepancy between a first value for a first field of the one or more fields associated with the first clearance communication and a second value for a second field of the one or more fields associated with the second clearance communication; and generating a user notification at the first aircraft in response to identifying the discrepancy.

11. The method of claim 10, wherein receiving the first clearance communication comprises receiving the first clearance communication from the second aircraft.

12. The method of claim 10, wherein receiving the first clearance communication comprises receiving the first clearance communication from air traffic control.

13. The method of claim 10, wherein:

determining the first clearance communication is related to the second clearance communication comprises determining the first clearance communication and the second clearance communication are both responsive to an air traffic control communication; and comparing the one or more fields associated with the first clearance communication with the one or more fields associated with the second clearance communication comprises identifying the discrepancy between an aircraft identifier field of the first and second clearance communications.

14. A method comprising:

receiving, at a first aircraft, a first clearance communication associated with a second aircraft different from the first aircraft;

obtaining, at the first aircraft, a second clearance communication associated with the first aircraft;

determining the first clearance communication is related to the second clearance communication when an operational parameter associated with the first clearance communication matches the operational parameter associated with the second clearance communication and a first conversational context associated with the first clearance communication matches a second conversational context associated with the second clearance communication; and in response to determining the first clearance communication is related to the second clearance communication:

comparing, at the first aircraft, one or more fields associated with the first clearance communication with the one or more fields associated with the second clearance communication to identify a discrepancy comprising a difference between a first aircraft identifier for an aircraft identifier field associated with the first clearance communication and a second aircraft identifier for the aircraft identifier field associated with the second clearance communication; and generating a user notification at the first aircraft in response to identifying the discrepancy.

15. The method of claim 14, wherein the operational parameter comprises one of a runway, a taxiway, a waypoint, a heading, an altitude and a flight level.

16. The method of claim 14, wherein determining the first clearance communication is related to the second clearance communication when the operational parameter associated with the first clearance communication matches the operational parameter associated with the second clearance communication comprises determining the first clearance communication and the second clearance communication have a subject or an action in common.

17. An aircraft system comprising:

a communications system to obtain a plurality of clearance communications comprising a first clearance communication associated with an aircraft and a second clearance communication associated with an air traffic control system;

a data storage element maintaining a table of entries corresponding to respective clearance communications of the plurality of clearance communications;

a user interface; and a processing system coupled to the data storage element, the user interface and the communications system to assign a conversational context corresponding to each respective clearance communication of the plurality of clearance communications to each respective entry in the table of entries, identify a first conversational context associated with the first clearance communication, identify a second conversational context associated with the second clearance communication, identify a discrepancy between a first entry associated with the first clearance communication of the plurality of clearance communications and a second entry associated with the second clearance communication of the plurality of clearance communications based at least in part on the first conversational context assigned to the first entry and the second conversational context assigned to the second entry, and generate a user notification via the user interface in response to the discrepancy, wherein identifying the discrepancy comprises:

determining the first clearance communication and the second clearance communication are related based on a relationship between the first conversational context and the second conversational context; and identifying the discrepancy between a first value of a parameter associated with the first clearance communication and a second value of the parameter associated with the second clearance communication.

18. The aircraft system of claim 17, wherein the discrepancy comprises one of an incorrect radio frequency associated with one of the first clearance communication and the second clearance communication, an incorrect communications channel associated with one of the first clearance communication and the second clearance communication, an incorrect call sign associated with one of the first clearance communication and the second clearance communication, and an aircraft responding to an instruction for a different aircraft.

19. A non-transitory computer-readable medium having computer-executable instructions stored thereon that, when executed by a processing system, cause the processing system to:

obtain a first clearance communication associated with an aircraft;

obtain a second clearance communication associated with an air traffic control system;

identify a first conversational context associated with the first clearance communication;

identify a second conversational context associated with the second clearance communication;

identify a discrepancy between the first clearance communication and the second clearance communication based at least in part on the first conversational context and the second conversational context, wherein identifying the discrepancy comprises:

determining the first clearance communication and the second clearance communication are related based on a relationship between the first conversational context and the second conversational context; and identifying the discrepancy between a first value of a parameter associated with the first clearance communication and a second value of the parameter associated with the second clearance communication; and in response to identifying the discrepancy, generate a user notification at one of the aircraft and the air traffic control system.

* * * * *